US006173658B1

(12) United States Patent
Moberg

(10) Patent No.: US 6,173,658 B1
(45) Date of Patent: Jan. 16, 2001

(54) TRANSPORT DEVICE

(75) Inventor: Thomas Moberg, Motala (SE)

(73) Assignee: Easy AB, Vaxjo (SE)

( * ) Notice: Under 35 U.S.C. 154(b), the term of this patent shall be extended for 0 days.

(21) Appl. No.: 09/402,166

(22) PCT Filed: Mar. 30, 1998

(86) PCT No.: PCT/SE98/00580

§ 371 Date: Mar. 21, 2000

§ 102(e) Date: Mar. 21, 2000

(87) PCT Pub. No.: WO98/43884

PCT Pub. Date: Oct. 8, 1998

(30) Foreign Application Priority Data

Apr. 1, 1997 (SE) ..... 9701190

(51) Int. Cl.[7] ..... B65D 19/00
(52) U.S. Cl. ..... 108/51.3; 108/52.1
(58) Field of Search ..... 108/51.3, 51.11, 108/52.1, 901

(56) References Cited

U.S. PATENT DOCUMENTS 3,659,534 * 5/1972 Childs ..... 108/51.3
3,911,834 10/1975 Quaintance .
3,952,672 4/1976 Gordon et al. .
4,185,565 1/1980 Nymoen .
5,383,409 * 1/1995 Hayakawa ..... 108/51.3

FOREIGN PATENT DOCUMENTS 0 183 140 6/1986 (EP) .
2 255 222 7/1975 (FR) .

* cited by examiner

*Primary Examiner*—Peter M. Cuomo
*Assistant Examiner*—Jerry A. Anderson
(74) *Attorney, Agent, or Firm*—Kenyon & Kenyon

(57) ABSTRACT

The present invention relates to a pallet comprising first and second base parts (A1 and B1), each folded from pieces of corrugated, waterproof fiber material, for instance paper. Rectangular pieces (A, B) are cut from rolls of fiber material and the two base parts are made by notching and folding the pieces according to separate sequences. The first base part (A1) is put into the second base part (B1) and beams (31) on the second base part are folded in under the first base part and constitutes the feet of the pallet. The beams have longitudinal, v-shaped inner stiffeners (21, 22). All surfaces and points on the two base parts in contact with each other are glued and all open edges on ends and openings are provided with waterproof layers.

3 Claims, 3 Drawing Sheets

A
1 2 3 4 5 6 7 8 9 10 11 12 13 14 14 13 12 11 10 9 8 7 6 5 4 3 2 1

A1
2
1 4 5 7 8 15 14 14 15 1 2
3 6 9 10 11 12 13 13 12 11 10 9 6 3

21
22
23
24
25
26
27
29
30
B
28

A1
B1
31

TRANSPORT DEVICE

BACKGROUND OF THE INVENTION

The present invention relates to a pallet for transport and handling of goods with a forklift truck and, particularly a pallet comprising at least two base parts made of corrugated, waterproof fiber material.

The pallet is an important aid in modern transports and is made in many different ways and designs. A traditional type of pallet is made of wood, which is heavy and contributes to increased transport weight and thereby increased transport costs. Many other pallet designs in different materials, for instance plastic or fiber material has been developed. Several solutions disclose pallets in which more or less complicated details of fiber material, preferably paper, corrugated or plane, are assembled to achieve the desired form and strength.

The pallets according to the Swedish patent applications 450 481, 450 482 and 459 251 disclose designs with three base parts assembled with a number of transverse elements with a circular or rectangular cross section. The elements are inserted through openings of corresponding shape in the three base parts so the pallet can be lifted with a fork from all sides. The designs are characterized by a large number of details which have to be assembled and by an extensive amount of holes that have to be made in the base parts.

U.S. Pat. No. 3,113,532 discloses a pallet design with one base part folded to a system of channels provided with openings permitting access from all sides. A number of supporting and stiffening elements are fit in between the channels. This pallet also has many details and requires many different operations to be assembled.

U.S. Pat. No. 5,285,731 discloses a pallet with a complicated folding pattern and many details. The pallet is only accessible with a fork from two opposite sides.

U.S. Pat. No. 5,911,834 discloses a pallet comprising a first base part with a great number of punched parties forming inner supports and providing openings for the fork legs. A first base part is enclosed by a second base part keeping the first base part together. The design is complicated and requires many punching and folding operations. A second design has one further element in the center of the first base part making the design even more detailed and complicated to manufacture and assemble.

U.S. Pat. No. 3,952,672 discloses a pallet that comprises a first base part folded around a second base part. This design also has many punched details, which have to be folded in different directions to create supports and channels.

All designs, except for the first three cited, disclose low pallet height which in fact requires less space but at the same time offers a limited bending strength which is unfavorable for their main purpose, namely to carry load. Common to all pallets cited is that cutting and punching give a great wastage, as the basic material cannot be effectively utilized. Many details and complicated procedures both at manufacturing of details and assembling contribute to high production costs. Since the life of the pallets is limited due to the type of material, it is important that they are simple to produce and cheap.

SUMMARY OF THE INVENTION

The object of present invention is to eliminate the disadvantages of the pallets described above and achieve a pallet whose base parts can be made from rolls of corrugated fiber material by just cutting pieces of appropriate length, completely without wastage, fold them to the required shape and assemble them to a pallet accessible from all sides and having a large bending and shearing strength in all directions.

A pallet according to the invention having the characteristics stated in claim 1 and the subsequent claims achieves this object.

BRIEF DESCRIPTION OF THE DRAWINGS

A preferred embodiment of the invention will now be described with reference to the enclosed drawings on which:

FIG. 1 is shown the upper side of a first rectangular piece A of preferably corrugated, waterproof fiber material having fiber layers on both sides and the corrugation lengthwise. It is cut to a length, which when folded according to the side view of FIG. 2, forms a first base part A1 with a length corresponding to a pallet of requested size. Since the rectangular piece A is symmetrical to a center line the same numbering is used on both sides of the center line.

The rectangular piece A is prepared by embossing (solid line means from above and dashed line from underneath) in order to obtain folding notches on the side towards which the material is to be folded. The material is divided into parts 1–14, which after folding give the base part A1 length and width of the pallet in question and a height which in the preferred embodiment corresponds to preferably half the height of the complete pallet.

The folding sequence is described in the table below:

| Part | Folding direction | Folding angle in degrees |
|---|---|---|
| 1 | upwards | 90 |
| 2 | upwards | 90 |
| 3 | upwards | 90 |
| 4 | downwards | 180 |
| 5 | upwards | 90 |
| 6 | upwards | 90 |
| 7 | downwards | 180 |
| 8 | upwards | 90 |
| 9 | upwards | 90 |
| 10 | downwards | 90 |
| 11 | downwards | 90 |
| 12 | upwards | 90 |
| 13 | upwards | 90 |
| 14 | downwards | 180 |

Figures 1, 2:
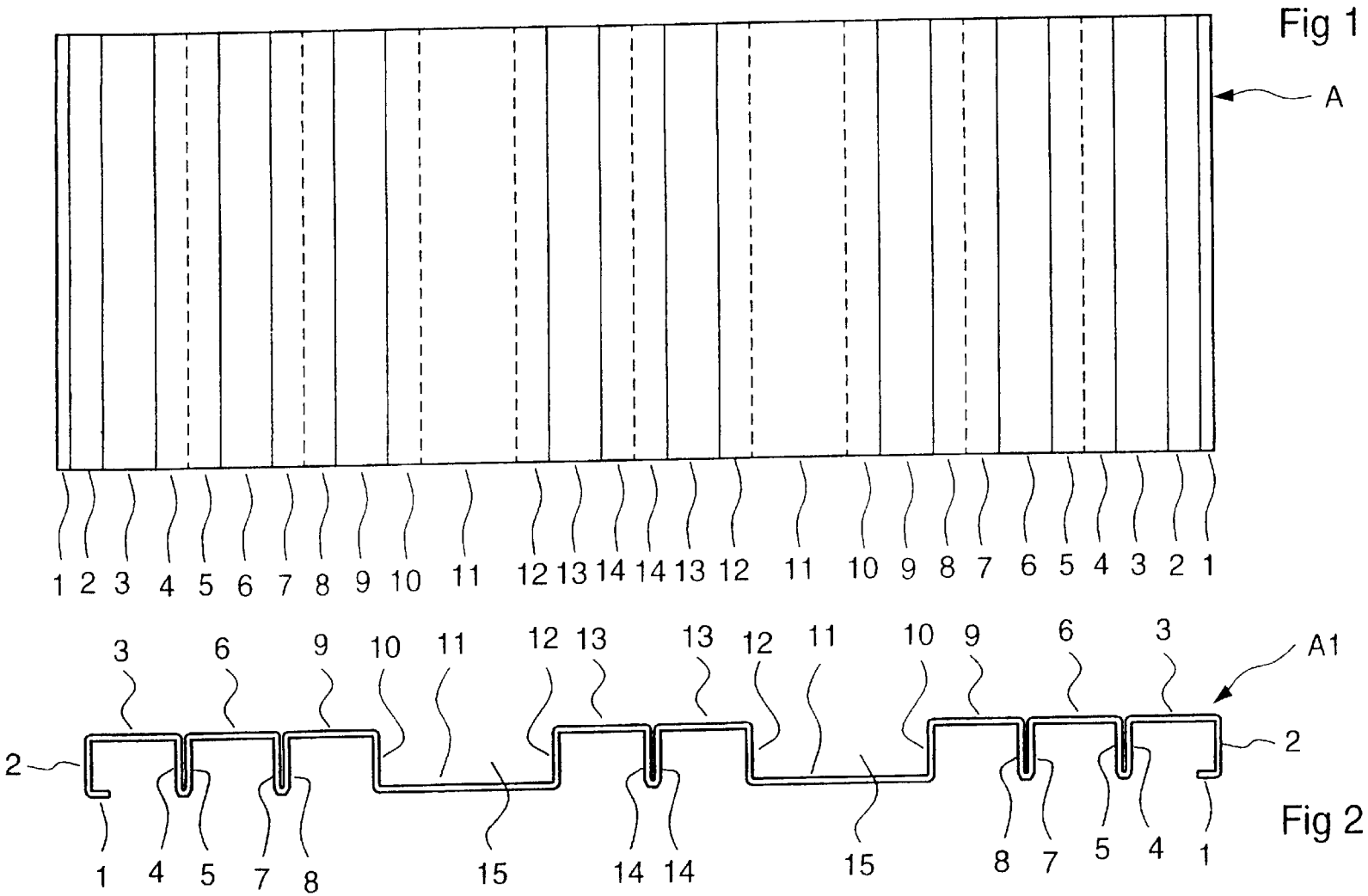
FIG. 1 shows a plane view of the upper side of a first piece of fiber material.
FIG. 2 shows a side view of a first base part, upside down.

After the piece A is folded according to this sequence, from the short sides and inwards, the surfaces between the parts 4 and 5, 7 and 8 and 14 and 14 are glued together. The piece A has now taken the shape of a first base part A1 for a pallet shown upside down in a side view in FIG. 2. The folding operations have formed a number of channels, three at each end and two in the middle. Between the outer and middle channels two spaces 15 are formed. These spaces have width, height and distance to each other permitting a fork of a fork lift truck to be positioned into them.

Figures 3, 4, 5:
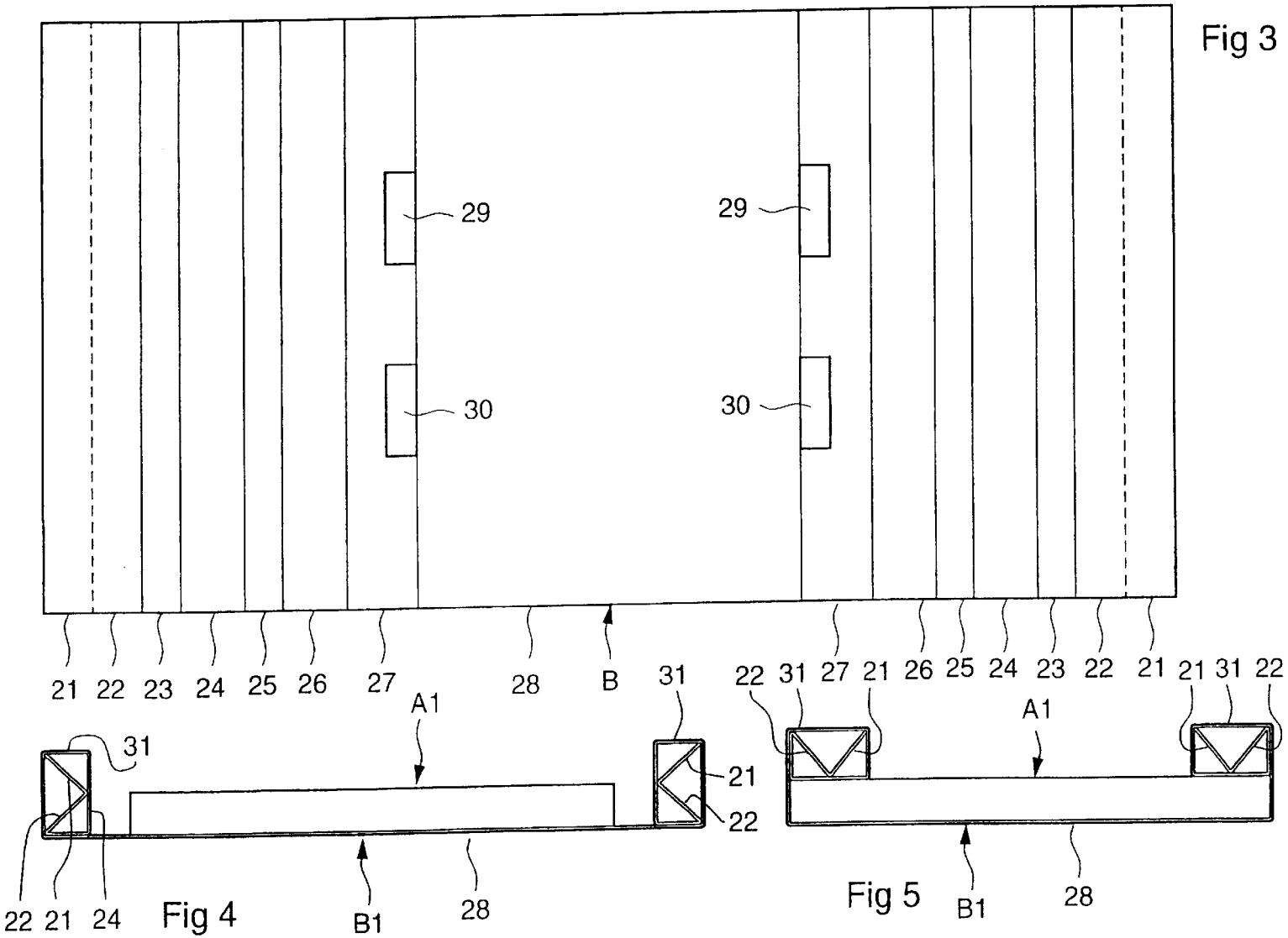
FIG. 3 shows a plane view of the upper side of a second piece of fiber material.
FIG. 4 shows a side view of a second base part in a first stage, upside down.
FIG. 5 shows a side view of a second base part joined to the first base part, upside down.

In FIG. 3 is shown a second rectangular piece B made from the same material as the piece A and with the corrugation in the longitudinal direction. It is cut to a length that forms a second base part B1 when folded according to the folding pattern shown in FIG. 3. This rectangular piece is also symmetric to a center line and for which reason the numbers are the same on both sides of the center line.

The second rectangular piece is treated by embossing in the same way as the first piece to achieve folding notches on the side towards which the material is to be folded. The second piece is divided into parts 21–28 as shown in FIG. 3.

In the parts 27, along the edges closest to the center line and symmetric to the longitudinal center line, openings 29 and 30 are made. The openings have width, height and distance to each other permitting a fork of a fork lift truck to be positioned into them, i. e., they have the same shape and dimensions as the spaces in the first base part A1.

The folding sequence is described in the table below:

| Part | Folding direction | Folding angle in degrees |
|---|---|---|
| 21 | downwards | ca 90 |
| 22 | upwards | ca 135 |
| 23 | upwards | 90 |
| 24 | downwards | 90 |
| 25 | upwards | 90 |
| 26 | upwards | 90 |

After the piece B has been folded according to the above sequence, up to the parts 23, from the short sides and inwards, the surfaces between the parts 23 and 27 are glued together. After the folding sequence has been carried out, the piece B has got the shape according to FIG. 4, which shows a side view of the second base part B1 upside down, where the part 28 is the upper side of the pallet.

The under side of part 28 and the parts 24 and 27 of the second base part B1 are covered with glue. The first base part A1 is then placed with the parts 1 and 11 and the points formed by the parts 4, 5 and 7, 8 against the part 28, with the two longitudinal beams 31 outside the long sides of the first base part A1 that the edges and the center lines of the base parts overlap, as shown in FIG. 4. The parts 27 are folded 90° upwards until they contact the edges of the channel openings in the long sides of the first base part A1 and the parts 24 will contact the underside of the parts 3, 6, 9 and 13 of the first base part A1.

Figure 6:
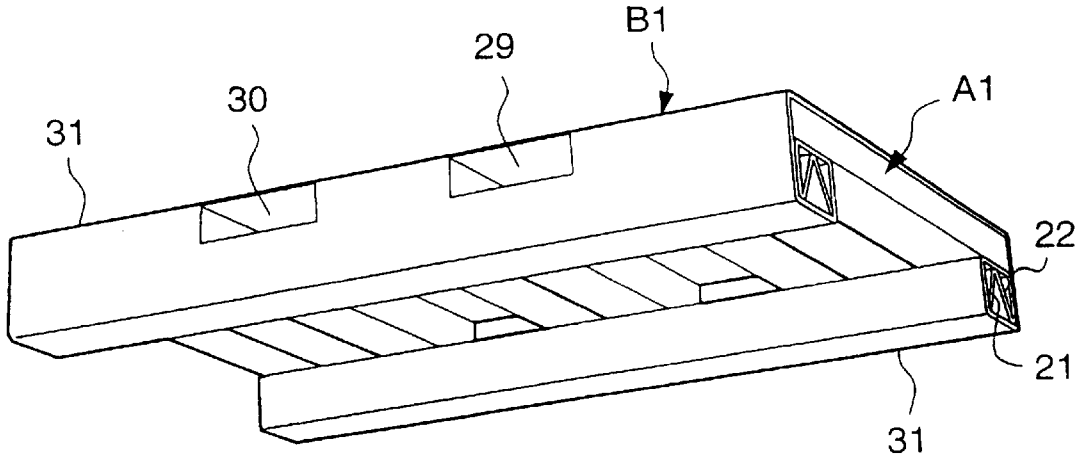
FIG. 6 shows a perspective view of a pallet from below.
Figure 7:
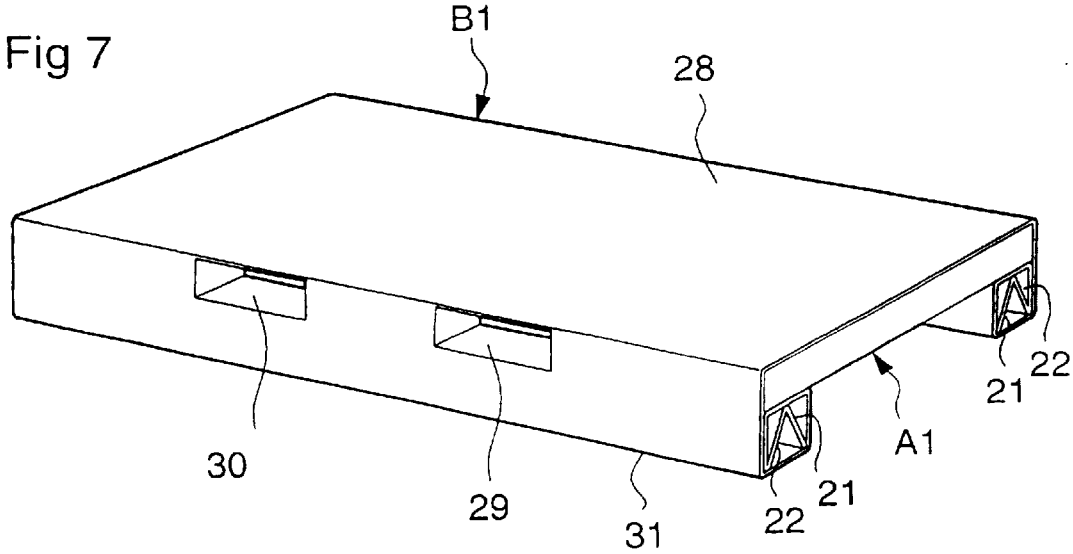
FIG. 7 shows a perspective view of a pallet from above.

The two base parts are fixed in this position until the glue has hardened. The result is a pallet shown in the perspective views in FIGS. 6 and 7.

The open end surfaces at the short sides are provided with a water protecting layer to prevent water to get in through the open cut surfaces in the two longitudinal beams 31 underneath the pallet and in the part 28. The cut surfaces of the openings 29 and 30 and the corresponding surfaces on the other side are also protected.

The pallet according to the invention is produced with a minimum of material wastage. The basic material is preferably a roll of corrugated paper with widths corresponding to the widths of pieces A and B, respectively. The pattern for each piece of material is the simplest possible and the number of operations by machine and hand are few and simple.

The longitudinal beams 31 of the pallet has a high strength regarding bending and shearing forces due to the interior stiffeners formed by the first and second parts 21 and 22. These parts also contribute to a high degree of impact resistance in the lower, edges of the beams, which is very important, as they are the most vulnerable parts of the pallet. The way the two base parts A1 and B1 are assembled provides the upper side of the pallet and thereby the top of the two fork channels for long side lifts, formed by the spaces 15 in the first base part A1, with two layers of corrugated material.

A pallet of the preferred embodiment described above has passed extensive handling and load tests without any remarks.

The weight of the pallet is low, only approximately 5.5 kg, while a pallet made of wood in dry condition weighs approximately 23 kg.

The pallet according to the invention is preferably intended to satisfy the requirements of European standard but can, within the scope of the invention, be made to satisfy other standards regarding shape, size and handling.

What is claimed is:

1. A pallet comprising at least two base parts made of corrugated fiber sheets, wherein a first rectangular piece, having a longitudinal corrugated layer with opposed long sides and short sides between an upper side and an under side and a width that after a first folding sequence forms a first base part symmetrical to a center line, is divided into 14 parts by fold lines of which the three first are made from the upper side, the fourth from the under side, the fifth and sixth from the upper side, the seventh from the under side, the eighth and ninth from the upper side, the tenth and eleventh from the under side, the twelfth and thirteenth from the upper side and the fourteenth from the under side, whereby the first piece, when folded at the fold lines, from the short sides towards a first center line, forms the first base part with three adjacent channels with rectangular cross-section at each end and a height preferably equal to half the height of the pallet and two adjacent channels with the same rectangular cross-section on each side of the first center line and spaces between the three adjacent channels and the two adjacent channels permit positioning of a fork on a fork lift truck, wherein a second rectangular piece having a longitudinal corrugated layer between an upper side and an under side and a width equal to the length of the pallet and after a second folding sequence forms a second base part, symmetrical to a second center line, said second rectangular piece is divided into 7 parts by fold lines of which the first fold lines are outer fold lines made in the under side and the other fold lines are in the upper side and wherein a distance between the two inner most pair of fold lines on either side of the second center line is equal to the width of the pallet and having rectangular openings with width, height and length and a distance to each other equal to the spaces in the first base part, whereby the second piece, when folded along the fold lines, from the ends towards the center, forms the second base part having longitudinal beams at each end with interior stiffeners formed by first and second parts, wherein the first base part is laid into the second base part with the longitudinal beams under the long sides of the first base part and the inner most part of the second piece outside the long sides so that the edges coincide, and the rectangular openings coincide with the spaces in the first base part and the longitudinal beams are in contact with the under sides of the channels of the first base part and support the pallet, and contacting surfaces and contacting points within and between the base parts are glued.

2. A pallet according to claim 1, wherein the first base part comprises two symmetrical parts made by folding the fourteen parts and the fourteenth parts are glued together.

3. A pallet according to claim 1, wherein the fiber sheets and all open cut surfaces are coated with waterproofing layers.

* * * * *

UNITED STATES PATENT AND TRADEMARK OFFICE

CERTIFICATE OF CORRECTION

PATENT NO. : 6,173,658 B1
DATED : January 16, 2001
INVENTOR(S) : Thomas Moberg

It is certified that error appears in the above-identified patent and that said Letters Patent is hereby corrected as shown below:

Column 2,
Line 22, after "below" insert -- and --.
Line 25, before "FIG" insert -- In --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*